United States Patent [19]

Westberg

[11] 4,082,217

[45] Apr. 4, 1978

[54] CENTRIFUGE APPARATUS

[75] Inventor: Johan Eric Hayden Westberg, Lidingo, Sweden

[73] Assignee: Separex SA, Chatel-Saint-Denis, Switzerland

[21] Appl. No.: 544,002

[22] Filed: Jan. 24, 1975

Related U.S. Application Data

[63] Continuation-in-part of Ser. No. 391,537, Aug. 27, 1973, Pat. No. 3,885,735.

[30] Foreign Application Priority Data

Jan. 28, 1974 Sweden ..... 7401046

[51] Int. Cl.[2] ..... B04B 9/00

[52] U.S. Cl. ..... 233/25; 233/26

[58] Field of Search ..... 233/1 R, 1 C, 23 A, 233/25, 26, 27, 23 R; 350/7; 74/573 F; 210/198 C; 55/67; 64/2 R, 2 P, 3

[56] References Cited

U.S. PATENT DOCUMENTS

| | | | |
|---|---|---|---|
| 489,202 | 1/1893 | Peck | 233/25 X |
| 3,235,173 | 2/1966 | Unger | 233/26 X |
| 3,347,454 | 10/1967 | Bellamy et al. | 233/26 X |
| 3,405,537 | 10/1968 | Thearle | 64/2 R |
| 3,498,533 | 3/1970 | Schomberg | 233/27 |
| 3,586,413 | 6/1971 | Adams | 350/7 |
| 3,657,941 | 4/1972 | Engler | 64/2 R |
| 3,674,197 | 7/1972 | Mitchell et al. | 233/26 |
| 3,684,161 | 8/1972 | Unger et al. | 233/26 |
| 3,775,309 | 11/1973 | Ito et al. | 210/198 C |
| 3,850,368 | 11/1974 | Boeckeler | 233/25 |
| 3,856,669 | 12/1974 | Ito et al. | 210/198 C |
| 3,885,735 | 5/1975 | Westberg | 233/25 |
| 3,905,208 | 9/1975 | Oyama et al. | 64/2 R |
| 3,921,898 | 11/1975 | Finkel | 233/23 A |
| 3,994,805 | 11/1976 | Ito | 210/198 C |

*Primary Examiner*—George H. Krizmanich
*Attorney, Agent, or Firm*—Hill, Gross, Simpson, Van Santen, Steadman, Chiara & Simpson

[57] ABSTRACT

A centrifuge apparatus, primarily for use in the continuous or semi-continuous separation of blood, has a disposable separation unit which is orbited on a centrifuge rotor. The separation unit has a sealed jacket which is held against rotation during the orbiting and communicates with a stationary and nonrotatable liquid inlet and outlet connector on the rotor axis. A separation vessel rotatably mounted in the jacket communicates with liquid inlet and outlet passages in the jacket and is rotationally unbalanced to orient itself relative to the rotor during the orbiting of the jacket.

34 Claims, 11 Drawing Figures

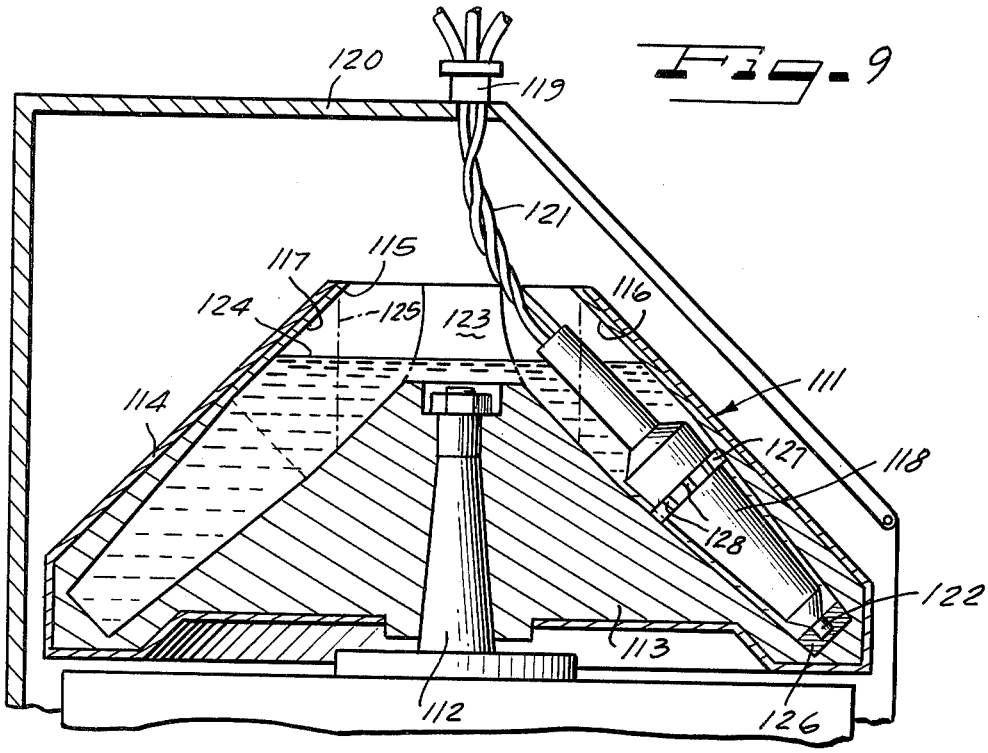
Fig. 9
Fig. 10
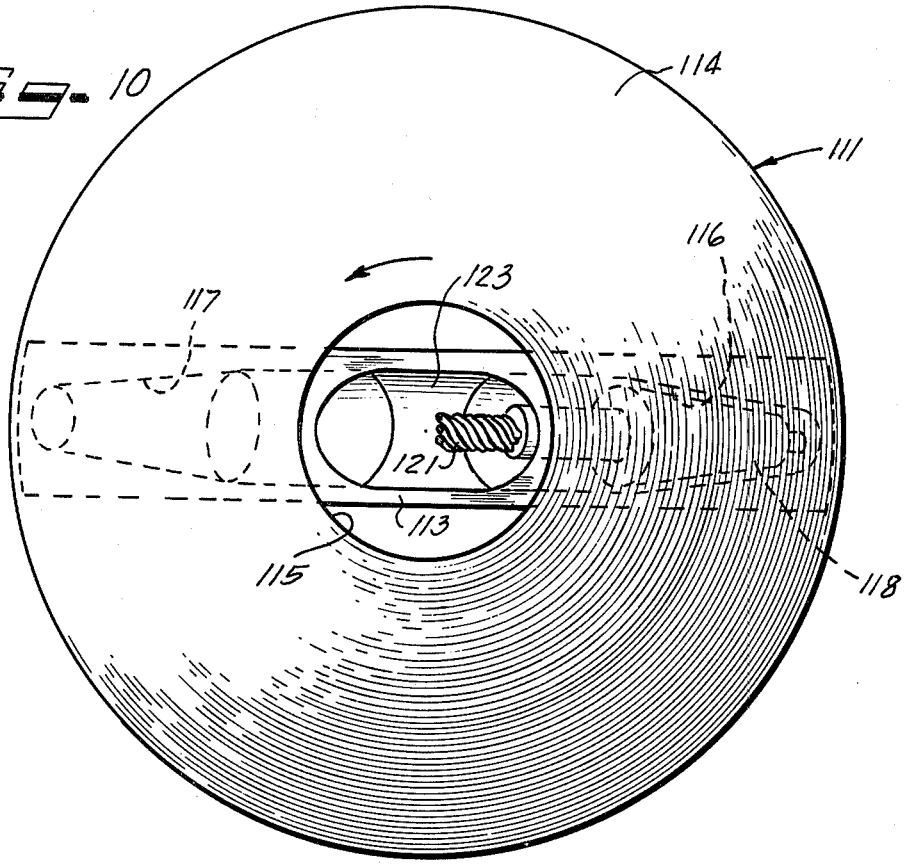

CENTRIFUGE APPARATUS

BACKGROUND OF THE INVENTION

Related Application

This application is a continuation-in-part of my pending application, Ser. No. 391,537, filed Aug. 27, 1973, now U.S. Pat. No. 3,885,735 issued May 27, 1975, said prior U.S. application being based on Swedish application Nos. 7094/72 filed May 30, 1972, 11636/72, filed Sept. 8, 1972, and 14193/72 filed Nov. 2, 1972 on which a claim of priority was based under 35 U.S.C. 119 as of Nov. 2, 1972, the present application including additional matter based on Swedish application No. 7401046-3 filed Jan. 28, 1974 on which a further claim of priority is based.

FIELD OF THE INVENTION

This invention relates to centrifugal separation of liquid and, more particularly, to centrifuge apparatus of the type having a centrifuge rotor which carries a container for the liquid to be separated and rapidly orbits the container about the axis of rotation of the rotor, as well as inlet and outlet conduits continuously conveying liquid to and from the container while the latter is being orbited. The invention is particularly useful in connection with the separation of blood or other biological liquids and accordingly the following description will be devoted primarily to that application.

PRIOR ART

In centrifuge apparatus of the aforementioned type, the continuous transfer of liquid between the orbiting container, in which the separation takes place, and the stationary accessories for conveying liquid to and from the container (such accessories may include a pump, a source of the liquid to be separated and one or more vessels for receiving and isolating separated fractions), involves difficult sealing problems, because the liquid transfer has to take place by way of a rotary seal. Such seals typically have a rotary part carried by the rotor on the axis of rotation of the latter and communicating with the container, and a stationary part sealingly engaging the rotary part and communicating with the stationary liquid conveying accessories.

Since a perfect seal between relatively rotating elements is always difficult to accomplish, known centrifuge apparatus often suffers from leakage between the rotary and the stationary parts. Outward leakage may soil the centrifuge, while inward leakage may contaminate the liquid to be separated and/or the separated fractions. Such contamination is particularly troublesome in the case of blood or other biological liquids which have to be treated under sterile conditions.

SUMMARY OF THE INVENTION

A general object of the invention is to provide in a centrifuge a separation unit including all the parts which are contacted by the liquid to be separated and in which there are no rotary seals between the spaces holding or conveying liquid to be treated and/or separated fractions, on the one hand, and the exterior side of the unit, on the other hand. A more particular object is to accomplish the foregoing general object in a separation unit having relatively few and inexpensive parts and thus lending itself to use as a disposable item.

These and other objects are realized in a separation unit having a jacket or housing which is nonrotatably connected with a connector member through a torsionally rigid but flexible body including conduits for conveying liquid between the connector member and the jacket. A separation vessel rotatably mounted in the jacket communicates with the conduits and includes orientation means. In use of the separation unit, the jacket is rotatably mounted on a centrifuge rotor and orbited about the axis of rotation of the rotor but held against rotation by the flexible body and the connector member which is secured to a stationary part of the centrifuge on or near the axis of rotation of the rotor. The orientation means, which preferably includes an unbalancing mass, maintains the separation vessel in a fixed angular position relative to the centrifuge rotor so that the heaviest liquid fraction is permitted to settle in the radially outermost portion of the separation vessel while the lighter fraction or fractions are permitted to settle radially inwardly of the heaviest fraction.

The invention will be fully understood from the following detailed description of exemplary embodiments with reference to the accompanying diagrammatic drawings.

ON THE DRAWINGS

FIG. 9 is an axial sectional view through a further centrifuge embodying the invention; and FIG. 10 is a plan view of the rotor of the centrifuge of FIG. 9.

AS SHOWN ON THE DRAWINGS

Figure 1:
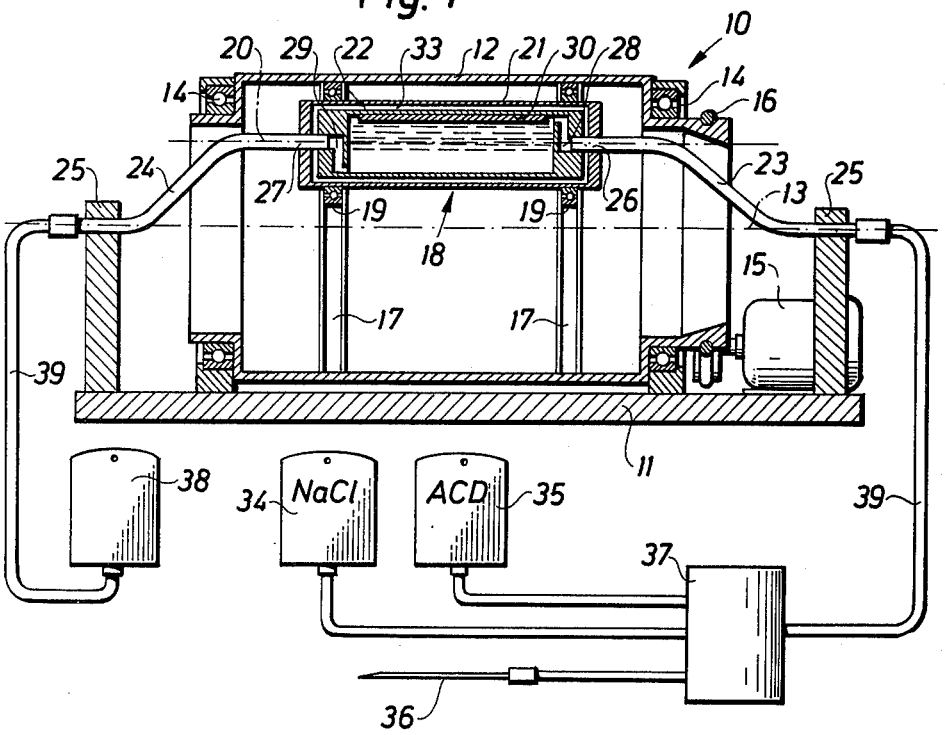
FIG. 1 is a view in longitudinal section of a centrifuge constructed in accordance with a first embodiment of the invention and includes a diagrammatic representation of accessories for feeding liquid to and receiving liquid from the centrifuge.
Figure 2:
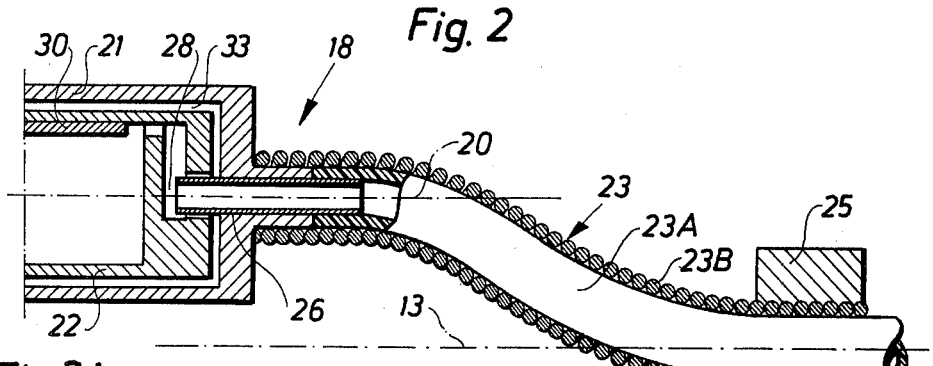
FIG. 2 is an enlarged fragmentary view in longitudinal section of a portion of the centrifuge shown in FIG. 1.

The centrifuge 10 shown in somewhat diagrammatic form in FIGS. 1 and 2 comprises a base plate 11 on which a hollow, generally cylindrical centrifuge rotor 12 is supported for rotation about a horizontal axis 13 in antifriction bearings 14. A drive unit including an electric motor 15 and a belt transmission 16 as well as control apparatus and a brake mechanism (not shown) is capable of rotating the rotor 12 at high speed and of rapidly reducing the rotational speed.

Disposed within the rotor 12 and radially displaceable therein along guides 17 to selected radial positions is a separation unit 18. Antifriction bearings 19 support the separation unit 18 for rotation relative to the rotor 12 and the guides 17 about an axis 20 parallel to but spaced from the rotor axis 13. Thus, during the rotation of the rotor 12 the separation unit 18 and, accordingly, the axis 20 are orbited about the rotor axis 13.

The separation unit 18, which may be constructed as a disposable item and discarded after a single use, includes a generally cylindrical housing or jacket 21, a separation vessel 22, which is also generally cylindrical and which is enclosed in the jacket 21 and freely rotatable relative to the latter about the aforementioned axis 20, and two flexible but torsionally rigid conduits 23 and 24, (which have non-flexible end portions) which are constantly in open communication with the separation vessel 22 adjacent opposite ends of the latter and extend from opposite ends of the jacket 21 to a pair of stationary brackets 25 disposed on the base plate 11 and holding a portion of each conduit relatively fixed on the rotor axis 13 and without rotation.

The end portions 26 and 27 of the conduits 23 and 24 adjacent the jacket 21 are rigid and fixedly secured to the latter and project coaxially with the jacket into a pair of recesses 28 and 29 in the end walls of the separation vessel 22 to form an axle or spindle on which the separation vessel is rotatable about the axis 20. As best seen in FIG. 2, the aforementioned end portions 26 and 27 are each formed by a short length of a stiff metal tube sealingly secured to the end wall of the jacket 21 and sealingly connected with a length of flexible plastic tubing 23A surrounded by a densely coiled helical spring 23B of steel wire. The ends of each spring 23B at 26,27 and in the brackets 25 have a fixed angular attitude, so that the intermediate flexible portion comprises a form of universal joint. The springs 23B are also referred to herein as elongated holder means and as flexible torque transmitting members.

Figure 3A:
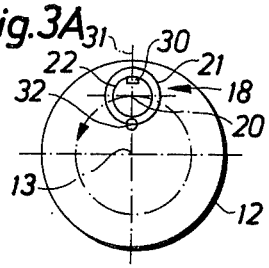
FIGS. 3A and 3B are diagrammatic cross-sectional views of the rotor of the centrifuge shown in FIG. 1.
Figure 3B:
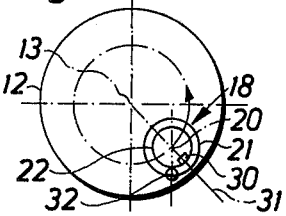

The separation vessel 22 is rotationally unbalanced with respect to its axis of rotation, which is defined by the axis 20. To this end, an axially extending unbalance weight 30 is attached to the cylindrical wall of the separation vessel to provide such unbalance. As a consequence, as the separation unit 18 is being orbited about the rotor axis 13, the separation vessel 22 will maintain a constant orientation, that is, a fixed angular or rotational position, relative to an imaginary line intersecting the axes 13 and 20. This is illustrated in FIGS. 3A and 3B which are diagrammatic cross-sectional representations of the rotor 12 and the separation unit 18 with the latter in two different angular positions. As seen from these figures, the separation vessel 22 does not rotate relative to the rotating line 31 joining the rotor axis 13 and the orbiting axis 20. In other words, the separation vessel does not rotate relative to the rotor 12, and hence every point on the separation vessel is always at a constant distance from the stationary rotor axis 13. The jacket 21, on the other hand, is continuously rotated relative to the rotor 12 about the orbiting axis 20 but does not change its orientation relative to the base plate 11 and the brackets 25. This is also seen from FIGS. 3A and 3B where the little circle 32 represents an arbitrarily chosen point on the circumference of the jacket.

As seen from FIG. 1, the two end recesses 28 and 29 are constantly in open communication with the interior of the separation vessel 22 at locations which are on opposite sides thereof. More particularly, the end recess 28 communicates with the separation vessel at a location adjacent the unbalance weight 30, that is, at a location where the contents of the separation vessel are subjected to the greatest centrifugal force during the orbital motion of the separation unit, while the end recess 29 communicates with the separation vessel at a location where the contents are subjected to the smallest centrifugal force.

The jacket 21 and the separation vessel 22 define between them an annular space 33 which extends throughout the length of the separation vessel 22 and communicates with the interior of the latter by way of the small clearances between the end walls of the separation vessel 22 and the spindle tubes 26 and 27; in FIG. 2 the clearance is greatly exaggerated for illustrative purposes. Thus, liquid fed into the separation vessel 22 through one of the flexible conduits 23 and 24 may enter and completely fill the space 33 but since the connections between the jacket 21 and the conduits 26,27, as well as the jacket itself are sealed, there is no possibility for the liquid to escape from the separation unit 18 except through the conduits.

The operation of the centrifuge 10 with the separation unit 18 will now be explained, assuming that it is being used for plasmapheresis in vivo. Plasmapheresis in vivo means that blood is taken from a live donor and separated into plasma and red blood cells (other components of the blood are disregarded here) whereupon the red blood cells are resuspended in isotonic saline and returned therewith to the donor while the plasma is collected in a separate container.

The auxiliary equipment necessary for plasmapheresis in vivo is diagrammatically shown in FIG. 1 and includes a flexible container 34 holding sterile isotonic saline (0.9 percent salt solution), a flexible container 35 holding an anticoagulant solution labeled ACD, a needle 36 through which blood is drawn from the donor and through which the saline with the red blood cells suspended therein is returned to the donor, a pump 37 connected to the containers 34 and 35 and the needle 36 as well as to one end of the separation unit 18. A third flexible container 38 holding a sterile solution, herein referred to as the priming solution, is connected to the other end of the separation unit.

The internal structure of the pump 37 forms no part of the invention and will not, therefore, be described. The function of the pump, however, will become apparent as the description proceeds. The pump 37 and the container 38 are connected respectively to the conduit 23 and the conduit 24 by way of flexible conduits 39 having sterile couplings.

The centrifuge rotor 12 is first started and the pump 37 is so operated as to draw the sterile priming solution from the container 38 into the separation vessel 22. The centrifugal force causes the priming solution to enter the annular space 33 and expel all air from the separation unit up to the point of the needle 36.

The needle 36 is then inserted into a vein of the donor and the pump 37 is so operated as to continuously draw blood from the donor, to add anticoagulant solution from the container 35 to the flowing blood and to pump the thus anticoagulated blood into the separation vessel 22. The priming solution in the separation vessel accordingly is gradually forced back to the container 38. In the separation vessel, the centrifugal force separates the incoming blood into a heavier red cell fraction, which is collected in the portion of the separation vessel which is radially outermost with respect to the rotor axis 13 (the upper portion in FIGS. 1, 2 and 3A, 3B) and a lighter plasma fraction which is collected in the radially innermost portion of the separation vessel.

As the separation of the continuously incoming blood proceeds, the separation vessel 22 becomes almost completely filled with a concentrate of red blood cells. At that time the pump 37 is so operated as to draw the cell concentrate from the separation vessel and return it to the donor after the cells have been suspended in saline supplied from the container 34. When practically all blood cells in the separation vessel and the conduits 23 and 39 have been drawn away and replaced by plasma from the container 38, the pump is again so operated as to draw blood from the donor and feed it with anticoagulant solution to the separation vessel whereupon the above-described procedure is repeated. The separation of the blood from the donor thus is accomplished in a semi-continuous fashion and is continued until a sufficient volume of plasma has been collected in the container 38.

As is seen from the foregoing description, there are no rotary seals where the liquid in the closed separation system may become contaminated. The only places where the liquid may leave the desired flow path are the small clearances between the walls of the separation vessel 22 and the tubes 26 and 27, but since the space outside of these clearances is completely filled with the priming solution, the tendency of the blood cells or the plasma to escape through the clearances is practically eliminated and, besides, the minimal escape that might take place causes no harm. The priming solution, which has a density nearly the same as the combined density of the filled separation vessel, also aids in relieving the tubes 26 and 27 from radial forces from the separation vessel 22. The latter practically floats in the priming solution and the tubes 26 and 27 only have to resist relatively small radial forces.

Figure 7:
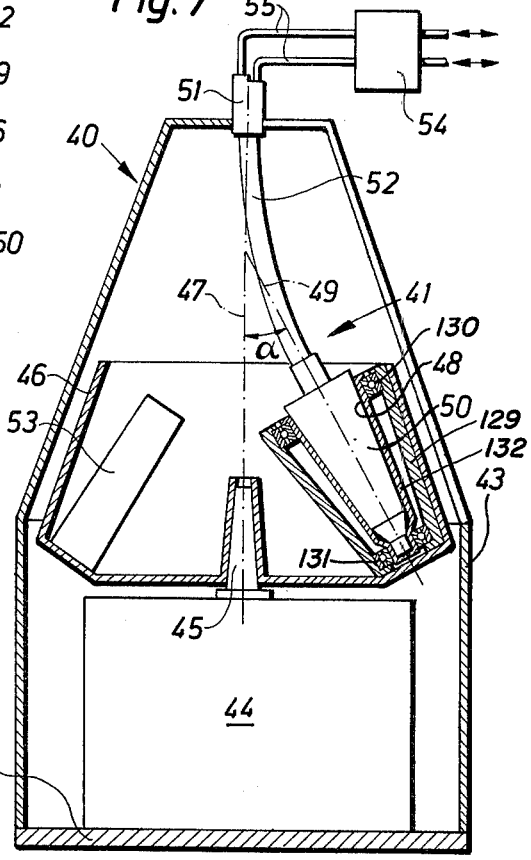
FIG. 7 is a diagrammatic view, partly in vertical section, of a centrifuge apparatus provided with the separation unit shown in FIG. 3 and accessories for feeding liquid to and from the separation unit.

FIGS. 4 to 7 show another embodiment of the centrifuge and the separation unit, generally designated 40 and 41, respectively. Referring first to FIG. 7, the centrifuge 40 includes, in addition to the separation unit, a base plate 42, a stationary means or cover 43, an electric motor 44 having an upwardly directed shaft 45, and a rotor 46 carried by the motor shaft for rotation about a vertical axis 47.

Adjacent its periphery, the rotor 46 fixedly carries a cup 129 having a frustoconical interior supporting a bearing 130 at its mouth and a bearing 131 at its bottom. An interior cup 132 is supported externally to its mouth and its bottom by inner races of the bearings 130,131 respectively. The interior cup 132 carries a frustoconical socket 48 which is freely rotatable relative to the rotor about an axis 49 intersecting the vertical rotor axis 47 and forming an acute angle $\alpha$ therewith. The socket 48 serves to receive and a hold frustoconical jacket 50 of the separation unit 41 which includes a stationary connector or connector member 51 nonrotatably held by the top of the cover or stationary means 43 and a flexible but torsionally rigid, slender body 52 which provides a nonrotatable mechanical connection as well as a fluid flow connection between the jacket 50 and the connector member 51. Rotation of the rotor 46 thus will cause the jacket 50 to orbit about the rotor axis 47 with the axis 49 generating a cone having its apex on the rotor axis. A counterweight 53 on the rotor balances the latter with respect to its axis 47.

Accessories for feeding liquid to and withdrawing liquid from the separation unit 41 through the stationary connector member 51 include a pump 54 and conduits 55.

Figure 4:
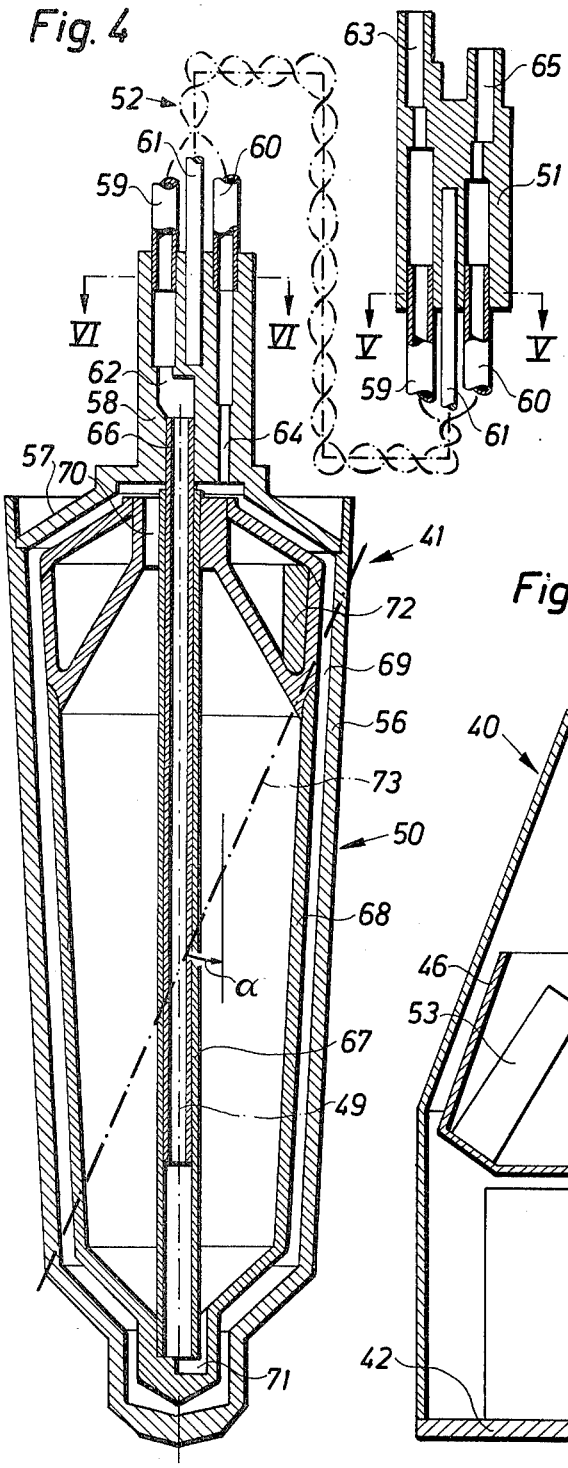
FIG. 4 is a view in longitudinal section of a separation unit constructed in accordance with a second embodiment of the invention.
Figure 5:
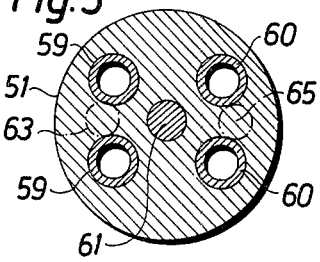
FIGS. 5 and 6 are cross-sectional views on lines V—V and VI—VI, respectively, in FIG. 4.
Figure 6:
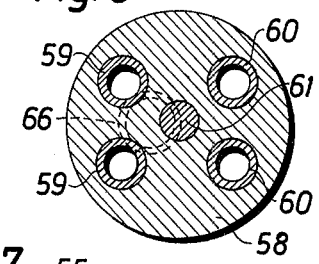

Referring to FIG. 4, the jacket 50 comprises a frustoconical cup 56 of circular cross-section and a cover 57 secured to and closing the wide end of the cup. A neck 58 integral with the cover projects axially outwardly from the jacket and serves as an attachment for one end of the flexible body 52, which comprises a pair of flexible conduit sections 59, another pair of similar flexible conduit sections 60, and a wire 61. The wire 61 is also referred to herein as an elongated holder and as a flexible torque transmitting member. The ends of the wire 61 have a fixed angular attitude, so that the intermediate flexible portion comprises a form of universal joint. The wire 61 is torsionally rigid and has one portion nonrotatably secured to the neck 58 and another portion fixedly secured to the stationary connector member 51 to prevent relative rotation of the jacket and the connector member. The four flexible conduit sections 59,60 are helically wound about the wire 61, and the conduit sections 59 are in constant open communication with a common passage 62 in the neck 58 and another common passage 63 in the connector member 51. Similarly, the conduit sections 60 are in constant open communication with a common passage 64 in the neck and a common passage 65 in the connector member.

A rigid tube 66, which is secured to the neck 58 and communicates with the passage 62, extends into the cup 56 coaxially with the axis 49 and is rotatably received in a tube 67 in a separation vessel 68 to support the latter for free rotation relative to the jacket 50 about the axis 49. The separation vessel 68 is of the same general shape as the jacket 50 with which it defines a narrow, closed annular space 69 completely surrounding the separation vessel 68. The end of the separation vessel 68 adjacent to the cover 57 is in constant open communication with the neck passage 64 through a passage 70 and the intervening portion of the annular space 69, and the opposite end is in constant open communication with the tube 66 through a passage 71 and the adjacent end portion of the tube 67.

An unbalancing weight 72 on the separation vessel 68 serves to keep it in a fixed rotational position relative to the rotor 46 as the separation unit 41 is being orbited, while the wire or holder means 61 prevents rotation of the jacket 50 relative to the connector member 51 and, accordingly, the cover 43. As seen from FIG. 4, where a phantom line 73 represents the vertical interface between separated fractions of different densities at an arbitrarily chosen time during a separation process, the unbalancing weight 72 is located such that the passage 70 is kept nearer the vertical rotor axis 47 than the passage 71.

The separation unit 41 operates in a manner generally similar to the separation unit 18 of FIG. 1 and the relation between the rotor 46, the jacket 56, the separation vessel 68, and the unbalancing weight 72 are operationally the same as that described for the elements 12, 21, 22 and 30 respectively of FIGS. 3A and 3B. Assuming that plasmapheresis is to be carried out, sterile priming solution is first fed into the orbiting separation unit through the passage 63 and the conduit sections 59. The priming solution first fills the separation vessel 68, then the annular space 69, the passage 64, the conduit sections 60 and the passage 65.

Blood is then continuously fed into the separation vessel 68 the same way as the priming solution which is thus gradually expelled from the separation vessel through the passages 70 and 64. Red blood cells are concentrated in the radially outermost portion of the separation vessel, to the right of the interface 73, while plasma is collected in the radially innermost portion and expelled therefrom the same way as the priming solution at a rate corresponding to the accumulation of the red cells. Since about half of the total volume of whole blood is plasma and the other half is made up of the red blood cells, the rates are approximately equal, provided that only relatively small volumes of ACD solution are fed into the centrifuge with the blood.

When the separation vessel is almost completely filled with the red cell concentrate, that is, when the interface 73 is near the passage 70, the direction of flow is reversed and plasma (or saline) is returned to the separation vessel to expel the red cell concentrate from the separation unit through the passage 71, the tubes 67 and 66, the passage 62, the conduit sections 59 and the passage 63.

As is best seen from FIG. 7, the flexible body 52 is curved only in one direction and the radius of curvature is relatively long. Accordingly, the body 52 can be made relatively short without attendant risk of fatigue failure. Unwanted oscillations of the flexible body are also practically eliminated by the helical coiling of the conduit sections 59 and 60. From FIGS. 4 to 7 it is also seen that the separation unit 41 is made of relatively few and inexpensive parts that are easy to dispose in and to remove from the centrifuge.

Figure 8:
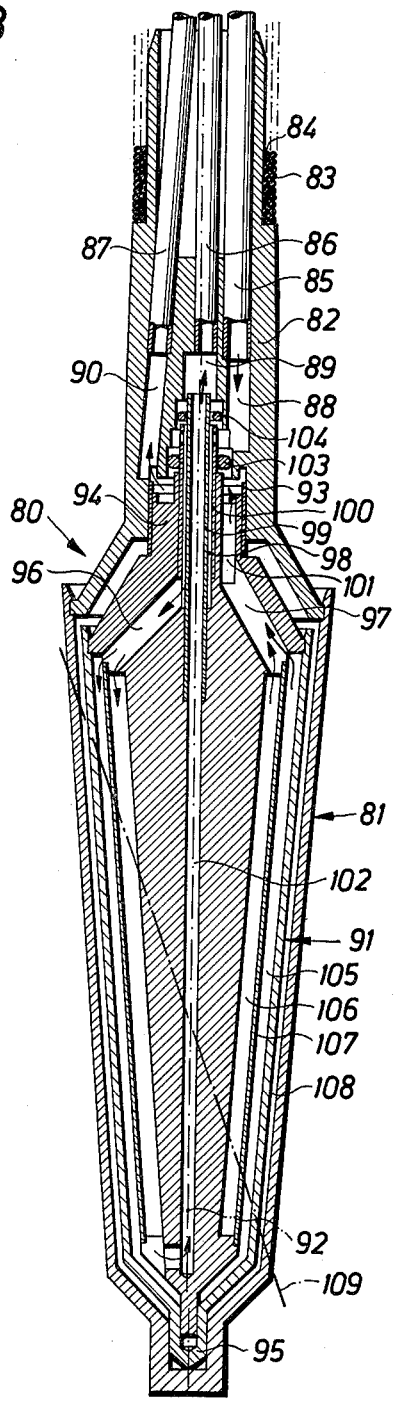
FIG. 8 is a view in longitudinal section showing a modification of the lower portion of the separation unit of FIG. 4.

FIG. 8 shows a separation unit 80 permitting a fully continuous separation of blood, for example. The separation unit 80 includes a jacket 81 generally similar to the jacket 56 of the separation unit of FIGS. 4 to 7, and a neck 82 on it is nonrotatably connected with a connector member (not shown) similar to the connector member 51 by two coaxial helical wire springs 83 and 84 which are densely coiled in opposite directions. The springs 83,84 are also referred to herein as elongated holder means and as a flexible torque transmitting member. The springs 83 and 84 are so held at their ends that they have a fixed angular attitude, so that their intermediate flexible portion comprises a form of universal joint. Three connector tubes 85,86,87 communicate with neck passages 88,89,90 at one end and are adapted to be connected with flexible conduit sections (not shown).

A separation vessel 91 having the same general shape as the jacket 81 is mounted for rotation therein about an axis 92. To this end, a short metal bushing 93 is inserted between a cylindrical upper end portion 94 of the separation vessel 91 and a cylindrical internal surface of the neck 82, and a cylindrical lower end portion 95 is rotatably received in a corresponding blind recess in the jacket 81.

The upper end portion of the separation vessel 91 has two inclined passages 96 and 97 extending from adjacent the axis 92 to diametrically opposite locations adjacent the periphery of the separation vessel. The upper end of the passage 96 is in constant open communication with the neck passage 88 through an annular space 98 defined between two coaxial tubes 99 and 100 secured to the separation vessel and projecting into the neck 82. The upper end of the other passage 97 is in constant open communication with the neck passage 90 through an axial passage 101 in the upper end portion 94. A passage 102 coaxial with the axis 92 has its upper end in constant open communication with the neck passage 89 through the inner tube 99. Sealing rings 103 and 104 prevent short circuit flow between the neck passages.

The separation vessel 91 defines two concentric annular separation spaces 105 and 106 separated by an annular wall 107. At their upper ends, both separation spaces are in constant open communication with both passage 96 and passage 97, and at their lower ends they are both in constant open communication with the axial passage 102.

The separation vessel 91 is rotationally unbalanced with respect to the axis 92 such that it is held in a fixed angular position relative to the centrifuge rotor when the operation unit 81 is orbited in a centrifuge similar to that shown in FIG. 7, namely, such that the passage 96 is directed radially outwardly away from the rotor axis and the passage 97 is directed radially inwardly towards the rotor axis. The unbalancing weight corresponding to the weights 30 and 72 is achieved by the asymmetric configuration of the separation vessel 91. In FIG. 8, there is more material to the left of the axis 92. For instance, the passage 101 lightens the side drawn to the right of the axis 92.

The separation unit 80 is used in a centrifuge similar to that shown in FIG. 7, and the operational relation between the rotor 46, the jacket 81, the separation vessel 91 and the built-in unbalance is the same as that explained for the elements 12, 21, 22 and 30 of FIGS. 3A and 3B, and before the separation of the blood is commenced, sterile saline is fed to the orbiting separation unit through the connector tube 85. The saline first enters the separation spaces 105,106 and then, under the influence of the centrifugal force, is forced along the bushing 93 into the annular space 108 between the separation vessel 91 and the jacket 81 to displace air therefrom. A slight clearance between the bushing 93 and the neck 82 which enables relative rotation also enables such flow.

When the saline has expelled all air from the separation unit, blood is continuously fed into the separation spaces through the connector tube 85. The red blood cells are accumulated in the radially outermost portion of the separation spaces (to the left of the vertical interface 109) while plasma is accumulated in the radially innermost portion. Blood cells and plasma are continuously withdrawn through the connector tubes 86 and 87, respectively, at such a rate that the interface 109 is maintained between the locations where the separation spaces 105 and 106 communicate with the plasma withdrawing passage 97 and the red cell withdrawing passage 102.

The bearing shown in FIG. 7 in the centrifuge are required to withstand substantial centrifugal forces as the rotational speed may be of the order of 3,000 to 4,000 rpm, but as shown in FIGS. 9 and 10, an arrangement is provided to avoid the use of antifriction bearings or other costly, bulky and delicate bearing elements.

A centrifuge rotor 111 is secured to a vertical motor shaft 112 and comprises a flat-sided body 113 and a truncated shell 114 enclosing the body 113, and having a circular opening 115 at the upper end. As shown in FIG. 9, the body 113 is approximately symmetrical about the axis of rotation, and on either side of this axis it is provided with a downwardly tapering socket 116,117 of truncated shape and circular cross-section and having its axis inclined 45° to the axis of rotation.

The socket 116 houses the correspondingly shaped jacket 118 having a separation vessel (not shown) corresponding to the separation vessels 68 or 69, in which the separation takes place, the jacket being connected fluidly to a stationary connector 119 on the centrifuge housing 120 by way of a number of flexible conduits and holder means jointly schematically indicated at 121 as described for FIGS. 4–8. The holders, or holder means, as described herein earlier prevent rotation of the jacket 118 about its own axis. The conical outer surface of the jacket 118 has a relatively small clearance with the wall of the socket 116. A cylindrical journal pin 122 at the lower end of the jacket projects into a corresponding recess in a bearing body 126 at the bottom of the socket 116 to fix the lower end of the jacket 118 radially. The upper ends of the sockets 116 and 117 communicate with each other fluidly by way of a diametrical groove 123 in the upper end of the rotor body 113.

Both of the sockets 116 and 117 are filled with a liquid which has a density that is approximately equal to, preferably slightly less than, the density of the jacket 118. This liquid can be water or any other liquid having the desired properties. The amount of liquid is such that the liquid surface 124 is slightly above the bottom of the groove 123 when the rotor 111 is at rest with the jacket 118 disposed in the socket 116. The water defines an essentially cylindrical surface (indicated at 125 in FIG. 9) when the rotor is rotating at high speed, such cylindrical surface being located radially outwardly of the edge of the opening 115. Both when the liquid level is at 124 or at 125, the major portion of the jacket 118 is submerged in the liquid. As shown in FIG. 9, only the upper portion of the neck of the jacket 118 extends beyond the liquid surface 124,125. Since the liquid has approximately the same density as the jacket 118, the liquid will, during rotation, balance the centrifugal forces acting on the jacket 118, so that the resulting force pressing the jacket against the wall of the socket 116 is relatively small. Thus the jacket is almost entirely freely rotatable in the socket 116 with the surrounding liquid acting as a bearing and as a lubricant. The liquid in the socket 117 serves as a balancing weight.

The balancing of the centrifuge rotor is effected by means of liquid in the second socket 117. However, the second socket 117 can be omitted and the balancing effected by means of separate balance weights. Further, the body 113 of the centrifuge rotor 111 is preferably made of material having approximately the same density as the liquid and the jacket, so that the second socket as well as separate balancing weights can be omitted. The balancing of the centrifuge rotor is thus achieved inherently.

Although no special journals are required to locate the jacket 118 radially and axially relatively to the rotor body 113, at least if the clearance between the jacket and the walls of the socket 116 is relatively small, it is preferred to provide the jacket with integral journal members 127 cooperating with the walls of the socket, to ensure that the jacket is always held in an exact position radially and axially. The journal members 122,127 have a loose or free fit permitting the liquid to enter the clearance space and act as a lubricant. The journal member 127 has grooves 128 permitting unrestricted liquid flow.

The flixed ends of the holder means at 121 corresponding to the ends of the spring 23B, the wire 61, and the springs 83,84 can comprise rigid straight elements interconnected by a universal joint.

Although the foregoing detailed description of embodiments refers only to plasmapheresis, it is to be understood that these embodiments, with no or only minor modifications, may also be used in connection with other liquid processing operations including centrifugal separation of liquid into fractions of different densities. One example is washing of freezing preservatives from thawed red blood cells. In that case, in order that the mixing of the red blood cells with the wash liquid may be facilitated, the separation unit may include means whereby the rotation of the separation vessel relative to the jacket may be selectively braked. Such means may include a selectively operable magnetic or mechanical brake acting between the separation vessel and the jacket.

I claim as my invention:

1. Apparatus for use with a centrifuge having a rotor rotatable about a first axis for separating a liquid mixture into fractions of different densities, comprising:

(a) a hollow jacket;

(b) bearing means, adapted to be mounted on the centrifuge rotor remotely from said first axis and engaging said jacket for supporting said jacket for relative rotation with respect to the rotor about a second axis;

(c) flexible inlet and outlet conduits for liquid connected at one end to said jacket;

(d) holder means for holding said jacket against rotation about said second axis, said holder means being adapted to be held stationary by a fixed reference remote from the rotor, and being positively connected to said jacket;

(e) a separation vessel disposed in and rotatably supported by said jacket for relative rotation about said second axis and communicating with said conduit; and (f) orientation means acting on said vessel for maintaining it in a fixed angular position about said second axis during rotor rotation.

2. Apparatus according to claim 1 in which the jacket and the separation vessel define between them an annular space having approximately the same axial extent as the separation vessel and communicating with one of the conduits.

3. Apparatus according to claim 1 in which the orientation means comprises an unbalancing mass on the separation vessel causing rotational unbalance of the separation vessel with respect to the second axis.

4. Apparatus according to claim 1 in which the inlet and outlet conduits open into the separation vessel at locations spaced along the second axis.

5. Apparatus according to claim 1 in which said conduits have portions protruding axially in the same general direction from one end of said jacket.

6. Apparatus according to claim 5 in which a rigid tube held concentric with the second axis by the jacket and extending axially into the separation vessel journals the separation vessel for rotation about the second axis and defines a section of a flow passage between one of the flexible conduit portions and a location in the separation vessel axially remote from said one end of the jacket.

7. Apparatus according to claim 5 in which the holder means is elongated and in which the flexible conduits are helically wound about the elongated holder.

8. Apparatus according to claim 5 in which the holder means comprises elongated torsionally rigid means secured to said one end of the jacket.

9. Apparatus according to claim 1 in which during centrifuging, the locations where said conduits open into the separation vessel will be disposed such that they are at different constant radial distances from the first axis.

10. Apparatus according to claim 9 in which the inlet and outlet conduits include a third flexible conduit communicating with one end of said jacket, one of said locations where said conduits open into the separation vessel being adjacent the end of the jacket remote from said one end of the jacket and the other two locations being adjacent said one end of the jacket and on opposite sides of the second axis.

11. Apparatus according to claim 1 including connector means connected fluidly to the other end of said conduits and mechanically to the stationary portion of said holder means adjacent said first axis.

12. Apparatus according to claim 1 in which said conduits have portions protruding axially in opposite directions from said jacket.

13. Apparatus according to claim 1 including a centrifuge rotor supporting said bearing means, and stationary means non-rotatably holding a portion of said holder means in a stationary position.

14. Apparatus according to claim 13 in which said second axis defines an acute angle with said first axis of rotation of the centrifuge rotor.

15. Apparatus according to claim 13 in which said bearing means further comprises a socket freely receptive of said jacket, and a liquid retained in said socket in surrounding relation to said jacket.

16. Apparatus according to claim 15 in which said rotor has effective density and size diametrically opposite to said socket which correspond to the combined density of that portion of the rotor having the socket with liquid therein, and with said jacket and the components carried thereby.

17. Apparatus according to claim 16 in which said jacket and the components carried thereby have a specific gravity corresponding to the liquid.

18. Apparatus according to claim 16 in which a second socket is disposed diametrically opposite to the first named socket, and is retentive of some of the liquid therein, said sockets being interconnected fluidly.

19. Apparatus according to claim 16 in which said rotor has a specific gravity corresponding to the liquid.

20. Apparatus according to claim 15, said bearing means acting between said jacket and said rotor within said socket for axially and radially locating the position of said jacket in said socket.

21. Apparatus according to claim 20 in which said locating means comprises an annular bearing on said jacket having axial passages enabling free liquid flow.

22. Apparatus according to claim 1 in which said holder means is elongated, one end of which is held stationary, the other end of which is rigidly connected to said jacket, and there being an intermediate portion functioning as a universal joint.

23. Apparatus for use with a centrifuge having a rotor rotatable about a first axis for separating a liquid mixture into fractions of different densities, comprising:

(a) a jacket adapted to be rotatably supported on the rotor for movement about a second axis;

(b) flexible inlet and outlet conduits for liquid connected at one end to said jacket;

(c) a separation vessel disposed in and rotatably supported by said jacket for relative rotation about said second axis and communicating with said conduit; and (d) orientation means acting on said vessel for maintaining it in a fixed angular position about said second axis during rotor rotation.

24. Apparatus according to claim 23 in which the jacket and the separation vessel define between them an annular space having approximately the same axial extent as the separation vessel and communicating with one of the conduits.

25. Apparatus according to claim 23 in which the orientation means comprises an unbalancing mass on the separation vessel causing rotational unbalance of the separation vessel with respect to the second axis.

26. Apparatus according to claim 23 in which the inlet and outlet conduits open into the separation vessel at locations spaced along the second axis.

27. Apparatus according to claim 23 in which said conduits have portions protruding axially in the same general direction from one end of said jacket.

28. Apparatus according to claim 27 in which a rigid tube held concentric with the second axis by the jacket and extending axially into the separation vessel journals the separation vessel for rotation about the second axis and defines a section of a flow passage between one of the flexible conduit portions and a location in the separation vessel axially remote from said one end of the jacket.

29. Apparatus according to claim 23 in which during centrifuging, the locations where said conduits open into the separation vessel will be disposed such that they are at different constant radial distances from the first axis.

30. Apparatus according to claim 29 in which the inlet and outlet conduits include a third flexible conduit communicating with one end of said jacket; one of said locations where said conduits open into the separation vessel being adjacent the end of the jacket remote from said one end of the jacket and the other two locations being adjacent said one end of the jacket and on opposite sides of the second axis.

31. Apparatus according to claim 23 in which said conduits have portions protruding axially in opposite directions from said jacket.

32. Apparatus for use with a centrifuge having a rotor in a stationary housing for separating a liquid mixture into fractions of different densities, comprising:

(a) a closed separation vessel to be supported on the centrifuge for rotation therewith;

(b) flexible inlet and outlet conduits each fixedly connected at one end to said separation vessel for passing liquid into and out of said separation vessel, the other end thereof being adapted to be fixedly secured to the centrifuge housing; and (c) a flexible torque-transmitting member extending along and combined with said conduits and connected at one end to said separation vessel, the other end thereof being fixedly secured with said other end of said conduits.

33. Apparatus according to claim 32 including a connector forming a part of said other ends.

34. Apparatus according to claim 32 in which said torque-transmitting member comprises densely coiled wire spring means extending about said conduits.

* * * * *